United States Patent [19]

Kaprelian

[11] Patent Number: 4,857,895

[45] Date of Patent: Aug. 15, 1989

[54] COMBINED SCATTER AND LIGHT OBSCURATION SMOKE DETECTOR

[76] Inventor: Edward K. Kaprelian, 15 Lowery La., Mendham, N.J. 07945

[21] Appl. No.: 91,588

[22] Filed: Aug. 31, 1987

[51] Int. Cl.[4] ..... G08B 17/10

[52] U.S. Cl. ..... 340/630; 250/578; 250/574; 356/438

[58] Field of Search ..... 340/628, 630, 578, 577; 250/573, 574, 575, 222.1, 222.2, 578; 356/435, 438, 439, 357, 338–343

[56] References Cited

U.S. PATENT DOCUMENTS

| | | | |
|---|---|---|---|
| 3,922,656 | 11/1975 | Horvath et al. | 356/439 |
| 3,994,603 | 11/1976 | Paschedag | 250/575 |
| 4,021,792 | 5/1977 | Ludt et al. | 250/574 |
| 4,166,960 | 9/1979 | Meili | 340/630 |
| 4,220,857 | 9/1980 | Bright | 250/340 |
| 4,300,133 | 11/1981 | Solomon | 340/630 |
| 4,547,675 | 10/1985 | Muggli et al. | 250/575 |
| 4,647,785 | 3/1987 | Morita | 340/630 |
| 4,680,756 | 7/1987 | Bauer | 340/630 |

FOREIGN PATENT DOCUMENTS

| | | | |
|---|---|---|---|
| 2711555 | 9/1978 | Fed. Rep. of Germany | 356/339 |
| 0019439 | 2/1981 | Japan | 356/439 |
| 6257345 | 12/1985 | Japan | 356/439 |

*Primary Examiner*—Joseph A. Orsino
*Assistant Examiner*—Jill D. Jackson

[57] ABSTRACT

In a combined obscuration and scattered-light smoke detector, light from a light source in a smoke chamber is reflected from an image-forming optical component onto a first light sensor which senses a reduced electrical signal in the presence of smoke while a second sensor, viewing light from the light source at an angle, senses an increased electrical signal in the presence of smoke. The output of each receptor is subjected to a band pass filter, an amplifier and a comparator; the resultant signals insure early and reliable activation of an alarm when even a low level of smoke is present in the smoke detector. A second light source having a wavelength different from that of the first light source provides, in the obscuration mode, added sensitivity to smoke.

18 Claims, 2 Drawing Sheets

COMBINED SCATTER AND LIGHT OBSCURATION SMOKE DETECTOR

BACKGROUND OF THE INVENTION

1. Field of the Invention

This invention relates to optical smoke detectors which employ detectors reponsive to both light obscuration and light scatter.

Light obscuration smoke detectors depend upon measurement of the degree of obscuration of a detector resulting from the presence of smoke between the detector and a light source. The light obscuration method of smoke detection is highly accurate and is used as the standard against which ionization and light scatter detectors are measured. Typically such a smoke detector comprises a chamber with an emitter the output of which is directed to a sensor at its opposite end. The chamber is provided with light trapped openings for admitting smoke. The presence of smoke in the direct optical pathway between the emitter and the sensor results in absorption of light, thus reducing the output of the sensor and, through suitable electronics, actuating an alarm.

Light scatter smoke detectors depend upon the back scatter or forward scatter of light, the so-called Tyndall effect, which results from the presence of smoke in a light beam. Typically, a light emitter such as a diode illuminates the inside of a smoke detector chamber while a sensor, the axis of sensitivity of which is directed at an angle to that of the emitter axis, monitors the chamber interior. The presence of smoke generates a signal in the sensor which is received by an amplifier and comparator, the latter having a threshold level. The presence of smoke increases the output of the sensor; when the threshold level is exceeded the alarm is actuated.

Because smoke detectors frequently are located in environments where airborne dust is present, it is necessary that the operation of the detector be effectively immune to the accumulation of dust and dirt within the chamber.

An important cause of malfunctions, such as false alarms, in many smoke detectors of the light scatter type is the presence of dust within the smoke chamber. The dust layer accumulating on the side, top or bottom walls has a higher reflectivity than that of the conventional black walls of the chamber; hence, stray light from the light source striking such dusty walls results in increased light reaching the light detector which interprets this increase as indicating the presence of smoke and consequently energizes the alarm. In the present invention substantially all of the light source is reflected back on itself, with only a small portion spilling over the edge of the reflector and onto the walls of the smoke chamber.

Smoke detectors of the obscuration type also tend to malfunction when dust accumulates within the smoke chamber. The signal received by the light detector is the sum of the light received directly from the light source less that absorbed by any smoke that may be present plus that reflected from the chamber walls. The accumulation of dust on the walls of the obscuration type of detector increases the level of this reflected light and thus acts as a significant secondary light source which, in the presence of a given level of smoke, counteracts the light attenuation induced by the smoke, increasing the level of smoke intensity tow hich it is intended to respond and thereby resulting in a potentiall dangerous delay in activating the alarm. In the present invention substantially all of the light from the light source is directed onto the light detector with almost no light striking the walls of the smoke chamber.

2. Description of Prior Art

The concept of reflecting light from a smoke detector light source back on itself has been shown in U.S. Pat. No. 4,221,485 to R. Schulze. In this smoke chamber, a spherical reflector receives light from an LED (light emitting diode) which is centered on a planar photodetector. In the absence of smoke most of the light from the LED is reflected back on itself without falling on the photodetector. However, even a small misalignment of the mirror during manufacture or as a result of conditions during use would divert the reflected light from the center of the LED and partially onto the photodetector sending the device into a alarm condition.

A smoke detector which allegedly responds to smoke in both the absorption mode and the light-scatter mode is shown in U.S. Pat. No. 3,922,655 to D. Lecuyer. Here a dual photo cell receives light from a single source. The function in the scatter mode is in accordance with general practice: one part of the photocell is directed at approximately a right angle to the axis of the light source and receives light scattered by the smoke. In the so-called absorption mode, a second part of the photocell receives light reflected from the walls of the smoke chamber via a mirror. The second part of the photocell is not optically aligned with the light source and does not receive light directly from the latter, a necessary condition for absorption mode function. Instead the second part of the cell actually receives light scattered by smoke in the chamber; in effect, the Lecuyer showing is in fact a combination of two light-scatter detectors.

SUMMARY OF THE INVENTION

An object of this invention is to provide a smoke detector which incorporates the features and functions of both light obscuration detection and light absorption detection.

This is accomplished through the use of a reflective optical component which controls and confines the output of the light source in such a manner as to avoid impinging the output of any surface within the smoke detector chamber which through reflection would lead to a misreading regarding the presence of smoke.

The basic system comprises a light source such as a light emitting diode, reflective optics, and a first light detector such as a photo diode for detection by obscuration, and a second light detecting diode for detection by scatter.

Modifications to the basic system include the addition of a second photodiode, the emitted light from which is reflected back on itself by the reflective optics which may be a concave mirror, a mirror-backed lens or similar arrangement.

The wavelengths of light employed are preferably in the near infrared, for example, at approximately 880 nanometers, although for the obscuration mode of detection a second light source of shorter wavelength, for example in the green at 500–550 nm, offers some advantage.

DESCRIPTION OF PREFERRED EMBODIMENTS

Figure 1:
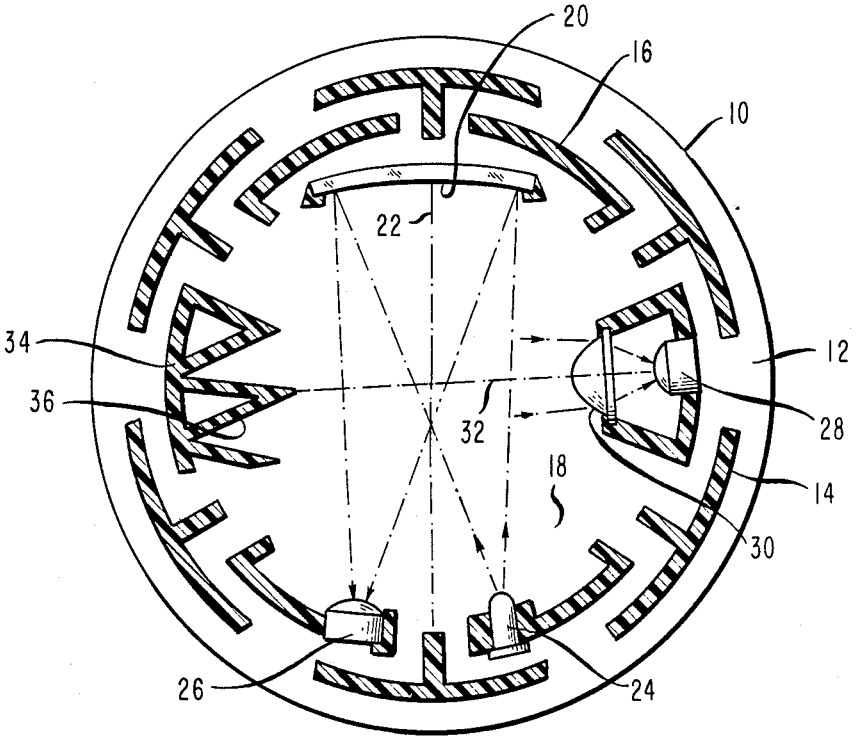
FIG. 1 is a horizontal cross section of an embodiment of the invention utilizing one light emitter and two light receptors.

FIG. 1 shows a first embodiment of the invention in plan view, the body of the smoke detector being designated generally as 10. The body comprises a base 12 which normally is attached to the top wall of the protected room or other enclosure. A series of segmented outer walls 14 and a series of segmented inner walls 16, preferably molded from a black thermoplastic and integral with the base, are formed and arranged to allow the ingress of smoke to smoke chamber 18 while blocking the entrance of ambient light. The top of the smoke detector, not shown, is a cover plate which is parallel to base plate 12 and which makes a light-tight fit with the side walls. Within the smoke chamber is a concave mirror 20 whose optical axis 22 is approximately parallel to the bottom and top walls.

Located to one side of the mirror's optical axis and spaced a short distance therefrom at the opposite side of the chamber is a light emitting diode 24, the optical axis of which is directed to the center of the mirror. This diode may emit either in the near infrared, at approximately 880 nm using, for example the National Semiconductor XC88P or XC880 light emitting diode (LED), or in the green at approximately 560 nm using, for example, the Hewlett-Packard HLMP 3950 LED. The light emitting diode is spaced from mirror 20 a distance equal to the latter's radius of curvature. Located at the other side of the mirror's optical axis and spaced from it a distance equal to that of the light emitting diode is a photo diode 26 upon which light from the light emitting diode is focused by mirror 20. The photodiode can be one of many that are commercially available, typical ones being those of the Hewlett-Packard 5082-4200 series.

A second photodiode 28 similar to photodiode 26 is located at one side of the smoke chamber with its axis 30 at an angle of about 95 degrees to the axis of the mirror. Photodiode 28 receives scattered light from smoke within the smoke chamber, its light acceptance enhanced by a condenser lens 32 molded of plastic and preferable aspheric in form. The angle of acceptance of the lens 32 and photodiode 28 combination is such that it does not "see" appreciably beyond the sides of a light trap 34 located on the opposite side wall. It is helped in this regard by the asphericity of the condenser lens which, by eliminating almost completely the spherical aberration present in a spherical-surface lens, avoids accepting appreciable amounts of light outside this limited field of view.

Light trap 34 consists of vee-shaped wedges whose edges are perpendicular to the top and bottom walls and the included angle of whose walls is approximately 36 degrees. Light entering the trap is reflected between the black walls of the wedges with resultant high attenuation and substantially no outward reflection. In order to make most efficient use of the light trap, surfaces 36 should be flat and highly polished in contrast with the remainder of the interior of the smoke chamber which is preferably provided with a matte finish to insure against unwanted reflections at the smoke entry areas.

Under conditions of smokelessness light sensor 26 will receive the normal full output of light emitting diode 24. Hence the output of sensor 26 as received by its associated detection circuitry will be at a normal high level. By contrast, under the same conditions, sensor 28 will receive virtually no radiation and its output as received by its associated detection circuitry will be at a normal very low level.

Figure 2:
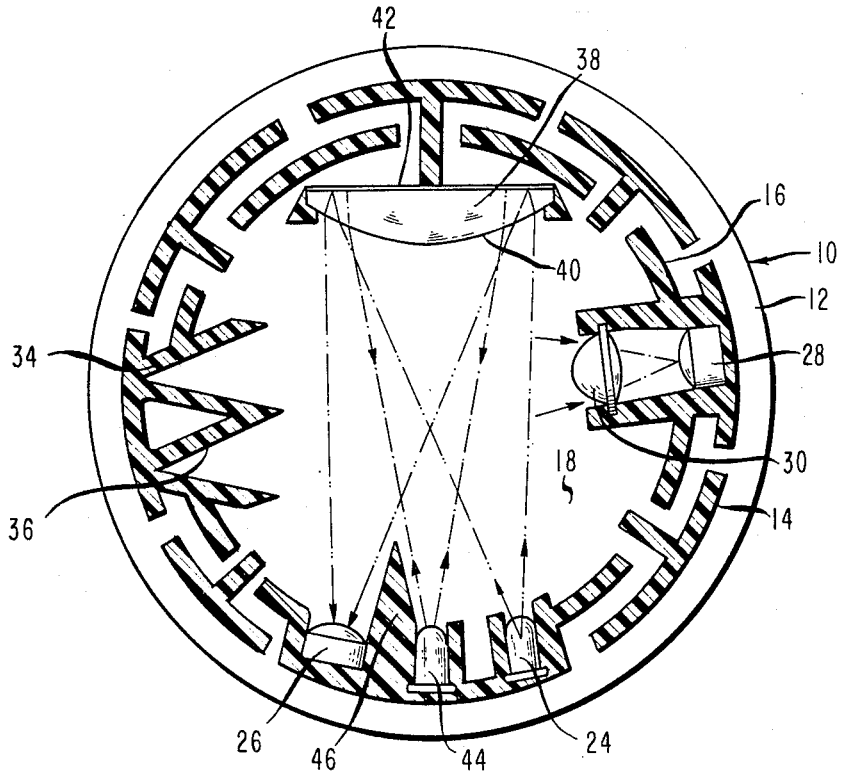
FIG. 2 is a horizontal cross section of a second embodiment of the invention utilizing two light emitters and two light receptors.

The modification of FIG. 2 utilizes the same general structure shown in FIG. 1, except that a catadioptric element 38 consisting of a glass or plastic lens having a convex surface 40 at its front and a reflecting surface 42 at its rear serves as the reflective optics in place of mirror 20 used in the modification of FIG. 1. Light emitting diode 24 and photodiode 26 perform here in the same manner as in FIG. 1. In this arrangement a second light emitting diode has been added to the system which is coaxial with catadioptric element 38 so that light received by the latter is reflected back onto LED 40. Thus, as in the case of the optical arrangement of light emitting diode 24 and photodiode 26, virtually no stray light is impinged on the walls of the smoke chamber. A baffle 46 prevents light from the edges of LED 44 from reaching photodiode 26.

In the modification of FIG. 2, photodiode 28, which detects in the light scatter mode, receives smoke-scattered light from the outputs of both light emitting diodes 24 and 40, thus increasing, by virtue of a higher level of light in the smoke chamber, its responsiveness to the presence of smoke.

Although the modification of FIG. 2 could use light emitting diodes having the same wavelength, for example 880 nm, there is an advantage in utilizing here a shorter wavelength for light emitting diode 24. Shorter wavelength light such as green is attenuated to a greater degree by sub-micron size smoke particles than is the case when utilizing near infrared wavelength. Black smoke is more readily detected in the absorption mode of the detector than in the scatter mode where the scatter level of black smoke is lower in comparison with gray or white smoke; this effect is enhanced with the shorter wavelength.

Figure 3:
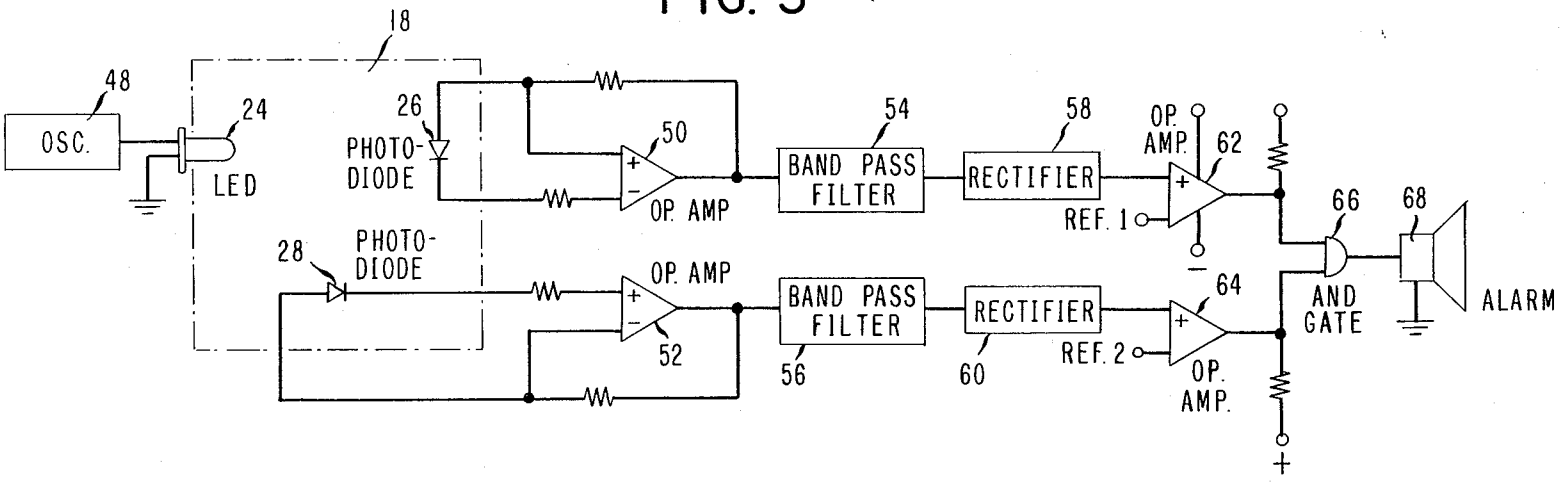
FIG. 3 is a circuit diagram in block form intended for use with either embodiment.

FIG. 3 shows a circuit arrangement for the modification of FIG. 1 which is also usable with the modification of FIG. 2. Here, an oscillator 48 operating at 10 kHz or other convenient frequency drives light emitting diode 24 in smoke chamber 18. The outputs of photodiodes 26 and 28 are fed to operational amplifiers 50 and 52 respectively, thence through band pass filters 54 and 56 respectively, and rectifiers 58 and 60 respectively. The output of rectifier 58 is received by an operational amplifier 62 acting as a comparator. A reference voltage REF 1 establishes a trigger threshold; when the output of photodiode 50 falls below this threshold as a result of the presence of smoke, comparator 62 will send a signal through AND gate 66 and energize alarm 68.

Correspondingly, when the output of photodiode 28 rises above a trigger threshold established at comparator 64 by reference voltage REF 2, comparator 64 will send a signal through AND gate 66 and energize alarm 68. Thus, either or both photodiode 26 in response to obscuration by smoke, and photodiode 28 in response to backscatter resulting from the presence of smoke will energize the alarm. Operational amplifiers 50, 52, 58 and 60 can each by one-fourth of the Texas Instruments operational amplifier TL086 or equivalent. The AND 66 can be the CD4081 made by RCA or equivalent. These components are given by example only; many other components and combinations are available to those skilled in the art for producing equivalent functions.

Figure 4:
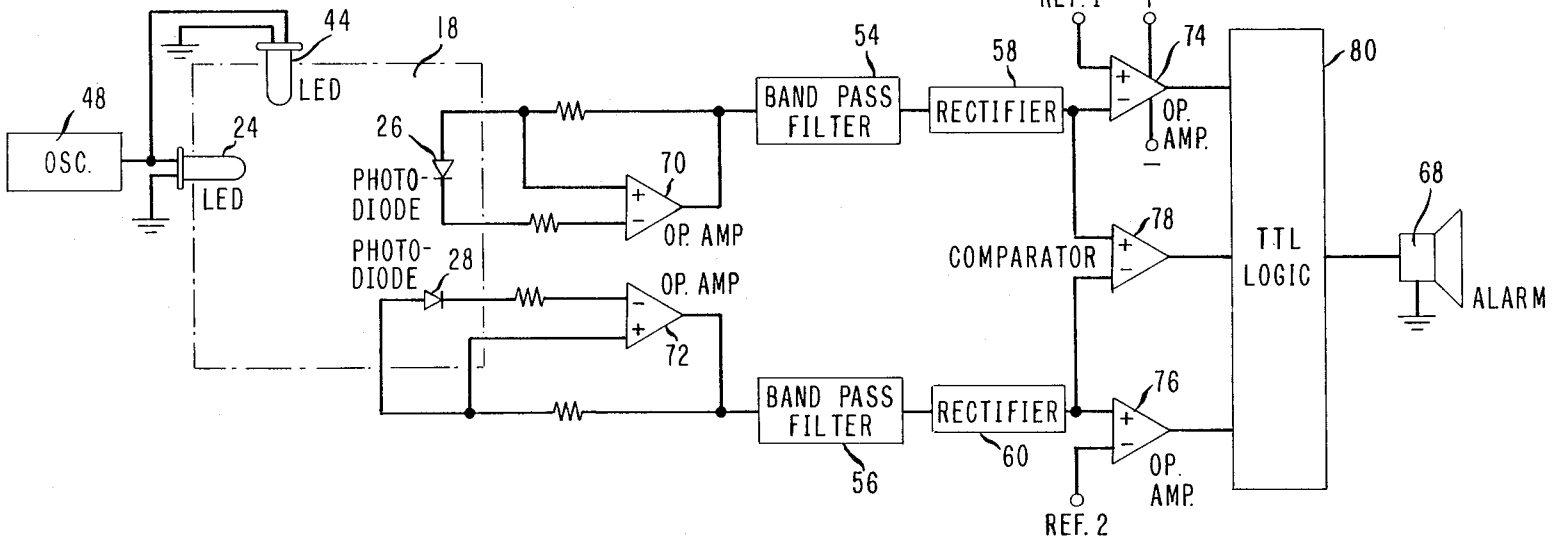
FIG. 4 is a circuit diagram in block form usable with either embodiment but which is especially suited for the embodiment of FIG. 2.

FIG. 4 shows a circuit arrangement for the modification of FIG. 2 which is also usable with the modification of FIG. 1. Here, light emitting diodes 24 and 44 in chamber 18 are driven by oscillator 48. The outputs of photodiodes 26 and 28 pass through operational amplifiers 70 and 72, band pass filters 54 and 56, rectifiers 58 and 60 to operational amplifiers 74 and 76, respectively, in the same manner as the corresponding components in FIG. 3. Operational amplifiers 70, 72, 74 and 76 can be parts of Texas Instruments operational amplifier TL072 or equivalent. A comparator 78, which may be a Texas Instrument TL084 or equivalent compares the outputs of photodiodes 26 and 28 and feeds its output to a TTL logic circuit 80 which also receives the outputs of operational amplifiers 74 and 76. When all the following conditions occur, logic circuit 80 will energize alarm 68:

1. The output of photodiode 26 falls below a predetermined level which may be 2% to 10% below the non-smoke output.
2. The output of photodiode 28 rises above a predetermined level which may be 2% to 10% above the non-smoke output.
3. The difference in the outputs of photodiodes 26 and 28 falls below a predetermined level.

Condition 3 provides an extra measure of protection in those situations of smoke accumulation where the difference in output between photodiodes 26 and 28 will reach a predetermined level sooner than the outputs of photodiodes 26 and 28 will reach their trigger levels which, in this instance, are set lower than in the case of FIG. 3.

I claim:

1. In a smoke detector having a smoke chamber comprising top and bottom walls together with side walls provided with light-trapped openings for the admission of smoke, an image-forming optical component within said smoke chamber having its optical axis substantially parallel to the top and bottom walls, a light emitter within said smoke chamber displaced to one side of said optical axis and directing light to said optical element, a first light sensor within said smoke chamber displaced to the opposite side of said optical axis and receiving light from said emitter by reflection from said optical component, and a second light sensor within said smoke chamber having its axis intercepting that of the axis of the optical component.

2. A smoke detector as claimed in claim 1, said optical component comprising an off-axis concave mirror.

3. A smoke detector as claimed in claim 1, said optical component being of off-axis form catadioptric form and having a front convex refracting surface and a rear reflecting surface.

4. A smoke detector as claimed in claim 1, the optical axis of the second light sensor intersecting the axis of said image forming optical component at an angle within 8 degrees of normal.

5. A smoke detector having a smoke chamber comprising side walls provided with light-trapped openings for the admission of smoke and a pair of substantially parallel top and bottom walls, said chamber containing an image-forming optical component having its optical axis substantially parallel to said top and bottom walls, a first light emitter within said chamber and spaced from and coaxial with said image-forming optical component a distance equal to twice the focal length of the optical component so that light emitted from the first light emitter is focused back on itself, a second light emitter within said chamber and displaced to one side of said optical axis and directing light to said optical component along an off-axis path, a first light sensor within said chamber and displaced to the opposite side of said optical axis and receiving light from said second light emitter via an off-axis path from said optical component and a second with sensor within said chamber having its axis intercepting the axis of the optical element.

6. A smoke detector as claimed in claim 5, said optical component comprising a concave mirror.

7. A smoke detector as claimed in claim 5, said optical component being catadioptric in form and having a front convex refracting surface and a rear reflecting surface.

8. A smoke detector as claimed in claim 5 the wavelength of light emitted by said first light emitter being different from that emitted by said second light emitter.

9. A smoke detector as claimed in claim 5, the wavelength of light emitted by said first light emitter being longer than the wavelength of light emitted by said second light emitter.

10. A smoke detector as claimed in claim 5, the wavelength of light emitted by the first light emitter being in the near infra red.

11. A smoke detector as claimed in claim 5, the wavelength of light emitted by the second light emitter being in the visible range.

12. A smoke detector as claimed in claim 5, said second light sensor receiving scattered light from said first and second light emitters.

13. The method of smoke detection comprising the steps of: emitting light from a source; receiving said light on an image-forming optical component; receiving an image of said source on a first light sensor via said optical component; detecting the attenuation of light at said first light sensor, said attenuation of light resulting from the presence of smoke in the space between said source and said optical component and in the space between said optical component and said first light sensor; receiving scattered light at a second light sensor, said scattered light resulting from the presence of smoke in said spaces; measuring the level of output of each of said sensors; and activating an indicator when either the output of said first light sensor falls below a predetermined level or when the output of said second sensor rises above a different predetermined level.

14. A method of smoke detection comprising: detecting attenuation of light on a first signal-emitting light sensor spaced apart from and having a direct optical path to a first light source of a given wavelength, said attenuation resulting from the presence of smoke between said first sensor and said first light source; detecting at a second signal-emitting light sensor, in the presence of said smoke, the scattering of light from a second light source having a wavelength longer than that of said first light source; measuring the level of output of each of said light sensors; and activating an indicator when either the output of said first light sensor falls below a predetermined level or when the output of said second light sensor rises above a different predetermined level.

15. A method of smoke detection comprising: detecting the attenuation of light on a first signal-emitting light sensor spaced apart from and having a direct optical path to a first light source of a given wavelength, said attenuation resulting from the presence of said smoke between said first sensor and said light source; detecting in the presence of smoke, on a second signal-emitting light sensor the scattering of light both from said first light source and from a second light source having a wavelength longer than that of said first light source; measuring the level of output of each of said light sensors; and activating an indicator when either the output of said first light sensor falls below a predetermined level or when the output of said second sensor rises above another predetermined level.

16. The method of smoke detection comprising the steps of: emitting light from a source; receiving said light on an image-forming optical component; receiving an image of said source on a first light sensor via said optical component; detecting the attenuation of light at said first light sensor, said attenuation of light resulting from the presence of smoke in the space between said source and said optical component and in the space between said optical component and said first light sensor; receiving scattered light at a second light sensor, said scattered light resulting from the presence of smoke in said spaces; measuring the difference in the outputs of said first and second light sensors; and activating an indicator when the difference in signal outputs of said first and second light sensors fall below a predetermined level.

17. A method of smoke detection comprising: detecting attenuation of light on a first signal-emitting light receptor spaced apart from a first light source of a given wavelength, said attenuation resulting from the presence of smoke between first receptor and said first light source; detecting at a second signal-emitting light detector, in the presence of said smoke, the scattering of light from a second light source having a wavelength longer than that of said first light source; measuring the difference in the outputs of the two light receptors; and activating an indicator when the difference in the levels of the signals emitted by said light receptors falls below a predetermined level.

18. A method of smoke detection comprising: detecting the attenuation of light on a first signal-emitting light receptor spaced apart from a first light source of a given wavelength, said attenuation resulting from the presence of smoke between said first receptor and said light source; detecting, in the presence of said smoke, on a second signal-emitting light receptor the scattering of light from said first light source and from a second light source having a wavelength longer than that of said first source; measuring the outputs of the two light receptors; and activating an indicator when the difference in the levels of the signals emitted by said light receptors falls below a predetermined level.

* * * * *